US007270233B2

(12) United States Patent
Kindt

(10) Patent No.: US 7,270,233 B2
(45) Date of Patent: Sep. 18, 2007

(54) PACKAGE FOR SEPARATE COMPOUNDS TO BE MIXED

(76) Inventor: John H. Kindt, 911 Brittley Way, Apex, NC (US) 27502

( * ) Notice: Subject to any disclaimer, the term of this patent is extended or adjusted under 35 U.S.C. 154(b) by 137 days.

(21) Appl. No.: 11/287,451

(22) Filed: Nov. 26, 2005

(65) Prior Publication Data

US 2007/0017831 A1 Jan. 25, 2007

Related U.S. Application Data

(60) Provisional application No. 60/701,017, filed on Jul. 21, 2005.

(51) Int. Cl.
*B65D 25/08* (2006.01)

(52) U.S. Cl. ..... 206/219; 206/568

(58) Field of Classification Search ..... 206/219–222, 206/568; 220/528–529, 532–533, 495.01, 220/495.02, 495.03, 495.06, 505; 366/53, 366/130; 215/6, 10, DIG. 8
See application file for complete search history.

(56) References Cited

U.S. PATENT DOCUMENTS 985,106 A 2/1911 Bradshaw
2,719,628 A 10/1955 Ivanoff
2,819,738 A 1/1958 Marberg
3,015,429 A * 1/1962 Morici ..... 206/568
3,305,368 A * 2/1967 Bourelle ..... 206/219
3,419,258 A 12/1968 Ritchie
3,797,646 A 3/1974 Horne
3,819,107 A 6/1974 Ryder, Jr.
4,130,198 A 12/1978 Aho
4,348,421 A * 9/1982 Sakakibara et al. ..... 206/219
4,395,162 A 7/1983 Murphy et al.
4,491,219 A 1/1985 Lutz
4,762,113 A * 8/1988 Hamasaki ..... 206/222
5,290,574 A * 3/1994 Jamieson et al. ..... 206/222
5,552,968 A * 9/1996 Ladyjensky ..... 206/219
6,364,105 B1 4/2002 Yacko et al.
6,648,164 B1 * 11/2003 DeCola et al. ..... 220/528
2004/0016655 A1 1/2004 Goodman

* cited by examiner

*Primary Examiner*—Luan K. Bui
(74) *Attorney, Agent, or Firm*—John V. Stewart

(57) ABSTRACT

A pail (50) for dry contents (32) with an inner container (20) for liquid contents (34). The inner container (20) has a lip (24) that overlays a lip (51) of the pail (50) for sealing of both the pail (50) and the inner container (20) with a common lid (52). The inner container (20) has two bottom walls (26, 28) forming an air pocket (30) to accommodate settling of the dry contents (34). The air pocket (30) may optionally contain instructions (36) for mixing and usage of the compounds (32, 34).

9 Claims, 3 Drawing Sheets

PACKAGE FOR SEPARATE COMPOUNDS TO BE MIXED

CROSS-REFERENCE TO RELATED APPLICATIONS

This application claims the benefit of U.S. provisional patent application 60/701,017, that was filed Jul. 21, 2005.

BACKGROUND OF THE INVENTION

1. Field of the Invention

This invention relates to packaging of two compounds to be mixed for use, particularly where one compound is dry and the other compound is a liquid.

2. Description of Prior Art

Some products such as plasters, cements, drywall finishing compounds and the like are stored in dry form to be mixed with water. In such products water may cause a catalytic hardening or curing by crystallization, so that the product will harden more quickly than by drying. This allows a construction or repair job to progress rapidly. Such products cannot be stored or transported for long periods in a premixed condition. Some construction cement can be transported in a mixer truck, but other such products have shorter curing times, and are used in smaller quantities, so they must be mixed on site shortly before use. Normally, the user must provide mixing water, and must measure the water accurately to obtain optimum consistency and final strength.

SUMMARY OF THE INVENTION

An ideal package for such material would contain premeasured amounts of mixing liquid and powder, protect them from shipping damage, be inexpensive, serve as its own mixing container, and be convenient to use. These features are provided in the present invention by a pail for dry contents with an inner container for liquid contents. The inner container has a lip that overlays the top lip of the pail for sealing of both the pail and the inner container with a common lid. The inner container has two bottom walls forming an air pocket to accommodate settling of the dry contents and to prevent its compaction by jostling of the liquid during shipping. The air pocket may optionally contain an instruction card for mixing and use of the compounds. Optionally the bottom and/or walls of the inner container may contain printed material such as instructions, product information, and product identification that may be viewed through a transparent liquid and through a transparent lid, without removal of the lid.

REFERENCE CHARACTERS

Figure 1:
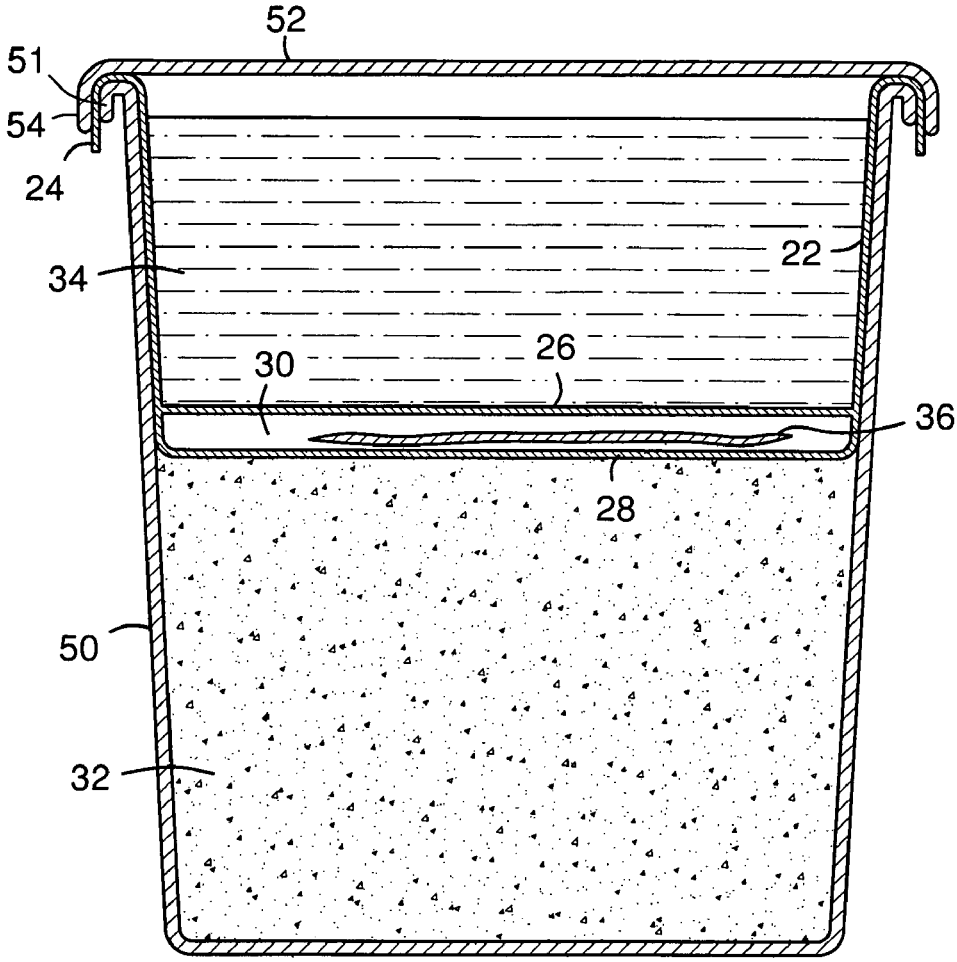
FIG. 1 is a side sectional view of a package for wet and dry compounds according to aspects of the invention.

20. Inner container
22. Sidewall of container
24. Lip on inner container

26. First bottom wall of inner container
27. Instructions on wall of inner container
28. Second bottom wall of inner container
30. Air space between first and second bottom walls
32. Dry compound to be mixed with liquid by a user
34. Liquid
36. Instruction sheet
50. Pail
51. Lip on pail
52. Pail lid
54. Pail lid lip

DETAILED DESCRIPTION

Figure 2:
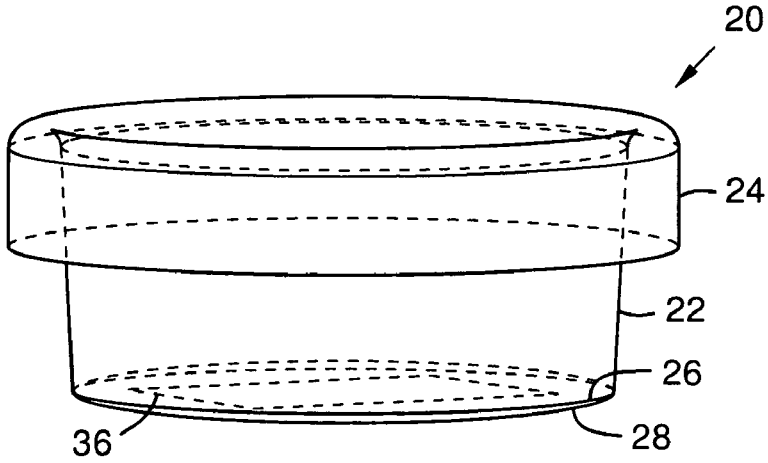
FIG. 2 is a perspective view of a liquid holding portion of the package of FIG. 1.
Figure 3:
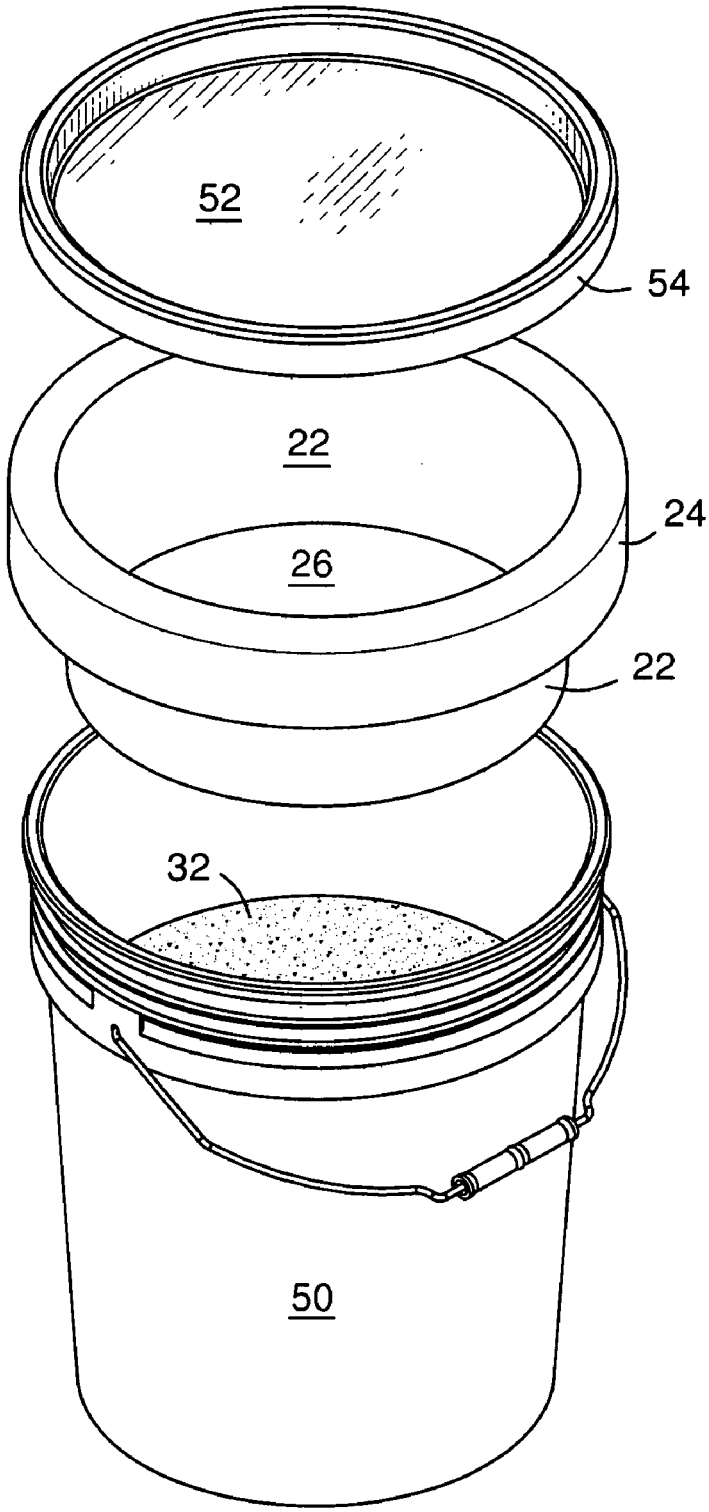
FIG. 3 is an exploded perspective view of a package for wet and dry compounds according to aspects of the invention.

FIG. 1 illustrates a package for separate wet and dry contents according to aspects of the invention. A pail 50 has a top end with a lip 51 and a bottom portion that holds dry contents such as drywall finish compound. An inner container 20, as seen separately in FIG. 2, has side walls 22 that fit into an upper portion of the pail, and has a top end with a lip 24 that overlays the pail lip 51. The inner container holds a measured amount of a liquid such as water to be mixed with the dry contents. A lid 52 fits tightly around both lips 24 and 51, thus sealing both the pail 50 and the inner container 20. The inner container has two bottom walls 26 and 28 with an air pocket 30 between them. The air pocket 30 provides cushion space between the wet and dry contents to avoid tamping of the dry contents by the wet contents during shipping.

Figure 4:
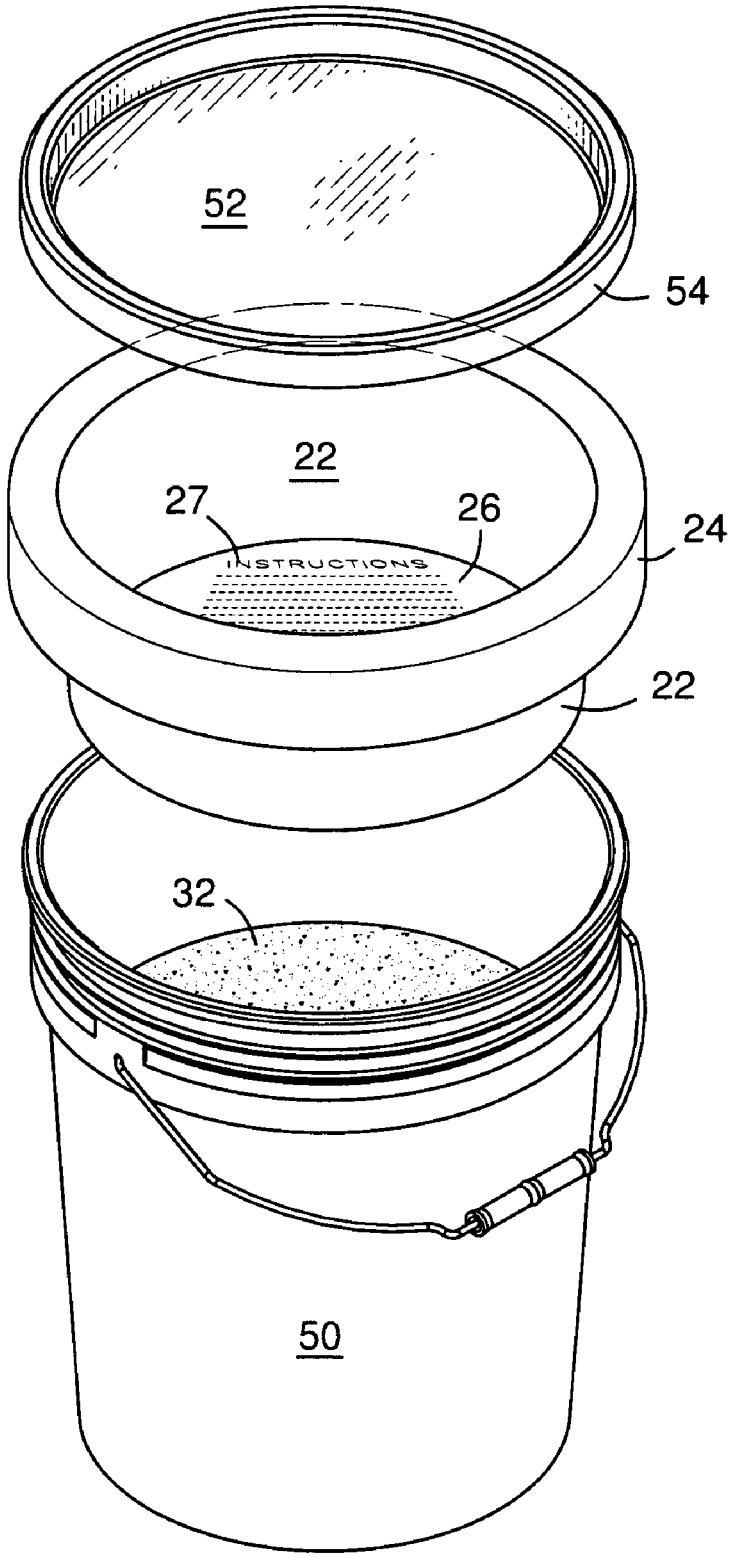
FIG. 4 is an exploded perspective view as in FIG. 3 with optional transparent lid and instructions on bottom wall of inner container.

A sheet of printed information may be enclosed between the two bottom walls 26 and 28 of the inner container 20. This material may include mixing and application instructions as well as product identification, marketing, and ornamentation. Alternately, such information 27 may be printed on the side walls 22 and/or one of the bottom walls 26 or 28 of the inner container 20 for viewing through the liquid 34 prior to removing the inner container from the pail. This assumes the liquid is substantially transparent. Optionally, the lid 52 may be formed of a substantially transparent plastic such as polyethylene terephthalate, polycarbonate, or other plastic as known in the art so the printed information can be viewed without removing the lid as illustrated in FIG. 4. This visual aspect provides a unique appearance for promotional purposes, and allows specific up-to-date product information to be provided conveniently by printing on a card in the air pocket or on the inner container walls.

The present invention is particularly intended for use with drywall finishing compound and similar products, but it can be used for any combination of two separate contents. In use, a user removes the lid, empties the liquid onto the dry contents, mixes them, and applies the product according to the instructions. A package according to the invention provides the following advantages:

- convenience and accurate mixing proportions without measurement by the end user;
- the user does not need to provide water for mixing on a job site;
- the liquid can contain ingredients besides water, such as a catalyst or stabilizer;
- the product manufacturer controls the quality and amount of the liquid;
- the product does not degrade in shipping.

The inner container is preferably formed of a flexible plastic membrane such as polyethylene, but it could alternately be formed of a semi-rigid material. The pail is preferably formed of a semi-rigid plastic, but could also be formed of other material, such as a metal.

Although the present invention has been described herein with respect to preferred embodiments, it will be understood that the foregoing description is intended to be illustrative, not restrictive. Modifications of the present invention will occur to those skilled in the art. All such modifications that fall within the scope of the appended claims are intended to be within the scope and spirit of the present invention.

I claim:

1. A package for separate compounds to be mixed, comprising:

a pail comprising an open upper end with a first lip;

an inner container in an upper portion of the pail, the inner container comprising a side wall, two bottom walls, and an open upper end with a second lip that overlays the first lip;

the two bottom walls of the inner container separated from each other by an air pocket;

a lid that fits tightly around the second lip when the second lip overlays the first lip, simultaneously sealing the pail and the inner container;

a dry particulate material in a bottom portion of the pail; and a pre-measured amount of a liquid in the inner container separated from the dry particulate material by the two bottom walls and the air pocket.

2. A package as in claim 1, wherein the inner container is formed of a flexible plastic membrane.

3. A package as in claim 1, further comprising a printed sheet enclosed in the air pocket.

4. A package as in claim 1, wherein the liquid is substantially transparent, and further comprising a sheet enclosed in the air pocket comprising information that is visible through the liquid.

5. A package as in claim 1, further comprising printing on at least one of the walls of the inner container that is visible through the liquid.

6. A package as in claim 1, wherein the liquid is substantially transparent, the lid is substantially transparent, and further comprising a printed sheet enclosed in the air pocket comprising information visible through the liquid and the lid.

7. A package as in claim 1, wherein the liquid is substantially transparent, the lid is substantially transparent, and further comprising printing on at least one of the walls of the inner container that is visible through the liquid and through the lid.

8. A package for separate wet and dry contents, comprising:

a pail comprising an open upper end with a first lip;

an inner container in an upper portion of the pail formed of a flexible plastic membrane comprising an open upper end with a second lip that overlays the first lip;

two bottom walls on the inner container separated from each other by an air pocket;

a lid that tightly fits around the second lip when the second lip overlays the first lip, simultaneously sealing the pail and the inner container;

a dry particulate material in a bottom portion of the pail;

a pre-measured amount of a liquid in the inner container separated from the dry particulate material by the two bottom walls and the air pocket; and a printed sheet enclosed in the air pocket.

9. A package for separate wet and dry contents, comprising:

a pail comprising an open upper end with a first lip;

an inner container in the pail comprising a side wall, an open upper end with a second lip that overlays the first lip, and two bottom walls with an air space between them;

a lid that tightly fits around the second lip when the second lip overlays the first lip, to simultaneously seal the pail and the inner container, the lid comprising a substantially clear portion;

a dry particulate material in a bottom portion of the pail;

a pre-measured amount of a generally clear liquid in the inner container separated from the dry particulate material by the walls of the inner container; and printing on at least one wall of the inner container visible through the clear portion of the lid.

* * * * *